US010247180B2

(12) United States Patent
Furet et al.

(10) Patent No.: US 10,247,180 B2
(45) Date of Patent: Apr. 2, 2019

(54) PUMP HAVING A CAP RETAINING A DIAPHRAGM IN A RECEPTACLE

(71) Applicant: DOSATRON INTERNATIONAL, Tresses (FR)

(72) Inventors: Sebastien Furet, Bordeaux (FR); Christophe Charriere, Camblanes et Meynac (FR); Philippe Duquennoy, Camarsac (FR)

(73) Assignee: DOSATRON INTERNATIONAL, Tresses (FR)

( * ) Notice: Subject to any disclaimer, the term of this patent is extended or adjusted under 35 U.S.C. 154(b) by 223 days.

(21) Appl. No.: 15/032,127

(22) PCT Filed: Oct. 27, 2014

(86) PCT No.: PCT/IB2014/065636

§ 371 (c)(1),
(2) Date: Apr. 26, 2016

(87) PCT Pub. No.: WO2015/063668

PCT Pub. Date: May 7, 2015

(65) Prior Publication Data

US 2016/0305424 A1 Oct. 20, 2016

(30) Foreign Application Priority Data

Oct. 30, 2013 (FR) ..... 13 60587

(51) Int. Cl.
*F04B 43/06* (2006.01)
*F04B 9/02* (2006.01)
(Continued)

(52) U.S. Cl.
CPC ..... *F04B 43/06* (2013.01); *F04B 9/02* (2013.01); *F04B 9/12* (2013.01); *F04B 43/02* (2013.01);
(Continued)

(58) Field of Classification Search
CPC .. F04B 53/1065; F04B 53/102; F04B 53/103; F04B 53/106; F04B 9/08; F04B 9/103; F04B 9/12; F04B 9/1207; F04B 9/123
See application file for complete search history.

(56) References Cited

U.S. PATENT DOCUMENTS 2,383,193 A * 8/1945 Herbert ..... F01L 25/08 417/317
2,700,876 A * 2/1955 Gagnan ..... F04B 9/103 137/210
(Continued)

FOREIGN PATENT DOCUMENTS

EP 1 971 774 A1 9/2008
FR 2 313 578 A1 12/1976
(Continued)

OTHER PUBLICATIONS

International Search Report, dated Mar. 3, 2015, from corresponding PCT Application.

*Primary Examiner* — Bryan Lettman
*Assistant Examiner* — Timothy P Solak
(74) *Attorney, Agent, or Firm* — Young & Thompson

(57) ABSTRACT

A diaphragm pump having a body including a suction connection and a discharge connection, a suction valve and a discharge valve; a control chamber in which the diaphragm is disposed, and a working chamber located on the side of the diaphragm opposite the control chamber; a control pipe suitable for linking the control chamber to a control connection of the body, the control pipe configured to alternately apply a vacuum and a pressure on the diaphragm; the body includes a housing oriented transversely relative to the control pipe, the housing being open towards the outside at one end, and closed at the other end by a bottom including a suction opening and a discharge opening, the diaphragm being positioned close to the bottom, and held by a cap engaged in the housing, the cap having a recess forming the control chamber, linked to a passage communicating with the control pipe.

20 Claims, 8 Drawing Sheets

(51) Int. Cl.

| | |
|---|---|
| ***F04B 9/12*** | (2006.01) |
| ***F04B 43/02*** | (2006.01) |
| ***F04B 53/16*** | (2006.01) |
| ***F04B 53/22*** | (2006.01) |
| ***F04B 53/10*** | (2006.01) |
| *F04B 13/00* | (2006.01) |
| *F04B 43/00* | (2006.01) |

(52) U.S. Cl.
CPC ..... *F04B 53/103* (2013.01); *F04B 53/16* (2013.01); *F04B 53/22* (2013.01); *F04B 13/00* (2013.01); *F04B 43/0054* (2013.01)

(56) References Cited

U.S. PATENT DOCUMENTS

| | | | | |
|---|---|---|---|---|
| 4,143,998 | A | 3/1979 | O'Connor | |
| 4,422,835 | A * | 12/1983 | McKee | F04B 43/073 417/401 |
| 5,803,122 | A * | 9/1998 | Theilmeier | F04B 53/1065 137/854 |
| 6,206,664 | B1 * | 3/2001 | Kakizawa | F04B 43/026 417/569 |
| 2002/0048519 | A1 * | 4/2002 | Spiteri-Gonzi | F04B 43/02 417/313 |
| 2004/0062662 | A1 | 4/2004 | Claude et al. | |
| 2005/0249610 | A1 * | 11/2005 | Fischer | F04B 43/02 417/360 |
| 2010/0021326 | A1 * | 1/2010 | Oguma | F04B 43/0054 417/472 |
| 2010/0282072 | A1 | 11/2010 | Darbois et al. | |
| 2013/0233421 | A1 | 9/2013 | Furet et al. | |

FOREIGN PATENT DOCUMENTS

| | | | |
|---|---|---|---|
| JP | S60-105936 | A | 6/1985 |
| WO | 2007/080249 | A1 | 7/2007 |
| WO | 2008/031419 | A2 | 3/2008 |
| WO | 2010/132372 | A2 | 11/2010 |
| WO | 2012/063184 | A1 | 5/2012 |

* cited by examiner

PUMP HAVING A CAP RETAINING A DIAPHRAGM IN A RECEPTACLE

The invention relates to a diaphragm pump of the type comprising a body which comprises:

a suction connection and a connection for discharge of the fluid to be pumped;

a suction valve and a discharge valve which are associated respectively with the suction and discharge connections;

a control chamber in which the diaphragm is disposed, and a working chamber which is situated on the side of the diaphragm opposite the control chamber;

a control pipe which can connect the control chamber to a control connection of the body, this control pipe making it possible to apply alternately partial vacuum and pressure on the diaphragm.

A diaphragm pump of this type is known in particular from WO 2012/063184 by the applicant company. The diaphragm pump is installed at the lower end of a measuring pump comprising a hydraulic motor with reciprocal motion which activates the diaphragm pump in order to inject an additive into the main current of liquid.

In a pump of this type, the diaphragm constitutes a relatively fragile component which must be able to be replaced from time to time. It is therefore desirable for the operation of removal and replacement of the diaphragm to be as simple as possible, with minimum incidence on the other components of the pump.

A diaphragm pump is also known from FR 2 313 578 with valves installed on a plate, the diaphragm being controlled by the core of an electromagnet, and not by the alternating application of partial vacuum and pressure. However in this case also, removal of the diaphragm makes it necessary to remove a plurality of components of the pump.

In addition, it is important for the design of the diaphragm pump to make it possible to reduce the dead volume which exists between the diaphragm in the position of rest, or at the start of suction, and the discharge valve, in order to facilitate the self-priming of the pump.

The objective of the invention is above all to provide a diaphragm pump which fulfils better than hitherto the aforementioned requirements, and which is simple to construct and reliable.

WO 2008/031419 relates to a diaphragm pump of the type in question, wherein the body comprises a receptacle which is open towards the exterior at one end, and is closed at its other end by a base comprising a suction orifice and a discharge orifice, the diaphragm being situated in the vicinity of the base, or against the base, and being retained by a cap which is engaged in the receptacle, this cap having, at its end which faces towards the diaphragm, a recess which constitutes the control chamber.

According to the invention, a diaphragm pump comprising the elements previously defined is characterized in that the receptacle is oriented transversely, and preferably at right-angles relative to the control pipe, the recess which constitutes the control chamber is connected to a passage which opens onto the lateral surface of the cap, in order to establish communication with the control pipe, and the cap is retained in place in the receptacle by a ring, which is connected, in particular by means of a thread, to the body of the pump, and comprising a means for retention of the cap.

In a pump of this type, the cap can be removed by simple translation after removal of the ring which retains this cap, thus making it possible to access the diaphragm and replace it if necessary without needing to intervene on the other elements of the pump. The cap is put into place by means of a simple translation movement.

Preferably, the pump comprises a valve device which comprises a plate in which the suction valve and the discharge valve are fitted, with the plate supporting the diaphragm, and being retained against the base of the receptacle by the cap.

The assembly of the valves installed on the plate, and of the diaphragm, constitutes an interchangeable device which can be withdrawn after removal of the cap, and replaced by a new assembly without intervention on the other components of the pump.

A suction orifice and a discharge orifice are provided in the base of the receptacle opposite the corresponding valves which are supported by the plate. A sealing ring which is fitted on the plate around each valve is designed to ensure the sealing between the plate and the pump body. At least one channel for flow of the fluid passes through the plate at the suction and discharge orifices. Preferably, a single channel is provided at the discharge orifice, in order to reduce the dead volume between the diaphragm and the discharge valve.

The plate can be snapped onto the end of the cap, in particular by means of resilient lugs which are provided on the cap.

The suction and discharge valves are advantageously constituted by valves of the umbrella type with a core engaged in an orifice in the plate, and a flexible flange or cover which closes the channel(s) which pass(es) through the plate. The valves can be in contact with the diaphragm when the pump is at rest or at the end of discharge, such that the dead volume between the diaphragm and the discharge valve is minimum. As a variant, the suction and discharge valves could be constituted by valves in the form of a duckbill comprising two flexible lips which are applied against one another according to a configuration in the form of a "V", the tip of which faces in the direction of flow of the fluid.

Also as a variant, the suction and discharge valves of the umbrella type or in the form of a duckbill can be disposed in receptacles in the pump body, and the diaphragm is applied directly against the base of the receptacle, without being disposed on a plate.

The angle which is formed between the geometric axes of the suction and discharge connections is preferably more than 90°, and in particular equal to 135°. Advantageously, the geometric axis of the suction connection is parallel to the geometric axis of the control pipe, whereas the geometric axis of the discharge connection forms an angle of 45°, or close to this value, with the geometric axis of the control pipe.

The cap can have a surface comprising a cylindrical part and a frusto-conical part which can be applied against a conjugated frusto-conical surface of the receptacle, with the passage provided in the cap for connection to the control pipe opening in this frusto-conical part, and being opposite the control pipe, and a means for polarization being provided on the lateral surface of the cap in order to cooperate with a means for polarization which is conjugated with the receptacle, in order to ensure the appropriate positioning of the passage relative to the control pipe.

The means for polarization can be constituted by a rib which is provided on the lateral surface of the cap in order to cooperate with a corresponding groove provided in the receptacle.

The sealing of the connection between the passage of the cap and the control pipe is advantageously ensured by a sealing ring, in particular an O-ring seal, which surrounds the output of the passage on the frusto-conical oblique surface.

This ring is preferably accommodated in a circular groove provided in the oblique surface of the cap. This arrangement with an oblique surface makes it possible to reduce the risk of damaging the sealing ring, in particular by pinching, during the fitting and the engagement in translation of the cap in the receptacle.

Advantageously, the passage which is provided in the cap in order to connect the control chamber to the control pipe extends along a length which is longer than the radius of the cap, in order to reduce the risk of interruption of the suction by adhesion of the diaphragm against the base of the control chamber.

The invention also relates to a valve device for a diaphragm pump as previously defined, comprising a plate in which there are fitted a suction valve and a discharge valve, in particular valves which have a cover in the form of an umbrella and a core which is accommodated in an orifice in the plate, said plate supporting a diaphragm. This valve device constitutes an interchangeable assembly for a diaphragm pump.

A diaphragm pump according to the invention is advantageously installed in the lower part of a proportional metering device such as described in WO 2012/063184, comprising a metering device body with a main liquid input and an output, a hydraulic motor which is accommodated in the body and is activated by the main liquid, the motor driving a plunger piston which ensures suction during an outward course which is transmitted by the control pipe to the control chamber of the diaphragm pump, and a discharge, which thrusts the diaphragm when the plunger piston carries out a return course.

A proportional metering device of this type, functioning without electricity, permits injection of auxiliary liquid supplied by the diaphragm pump.

Advantageously, for the retention of the pump on the metering device, the control connection of the diaphragm pump comprises a clamp which snaps onto the connection, and a means for connection to the metering device, in particular a nut, which is retained axially by said clamp.

In addition to the above-described arrangements, the invention consists of a certain number of other arrangements which will be described explicitly hereinafter with reference to embodiments described in relation to the drawings which are appended, but are in no way limiting. In these drawings.

Figure 5:
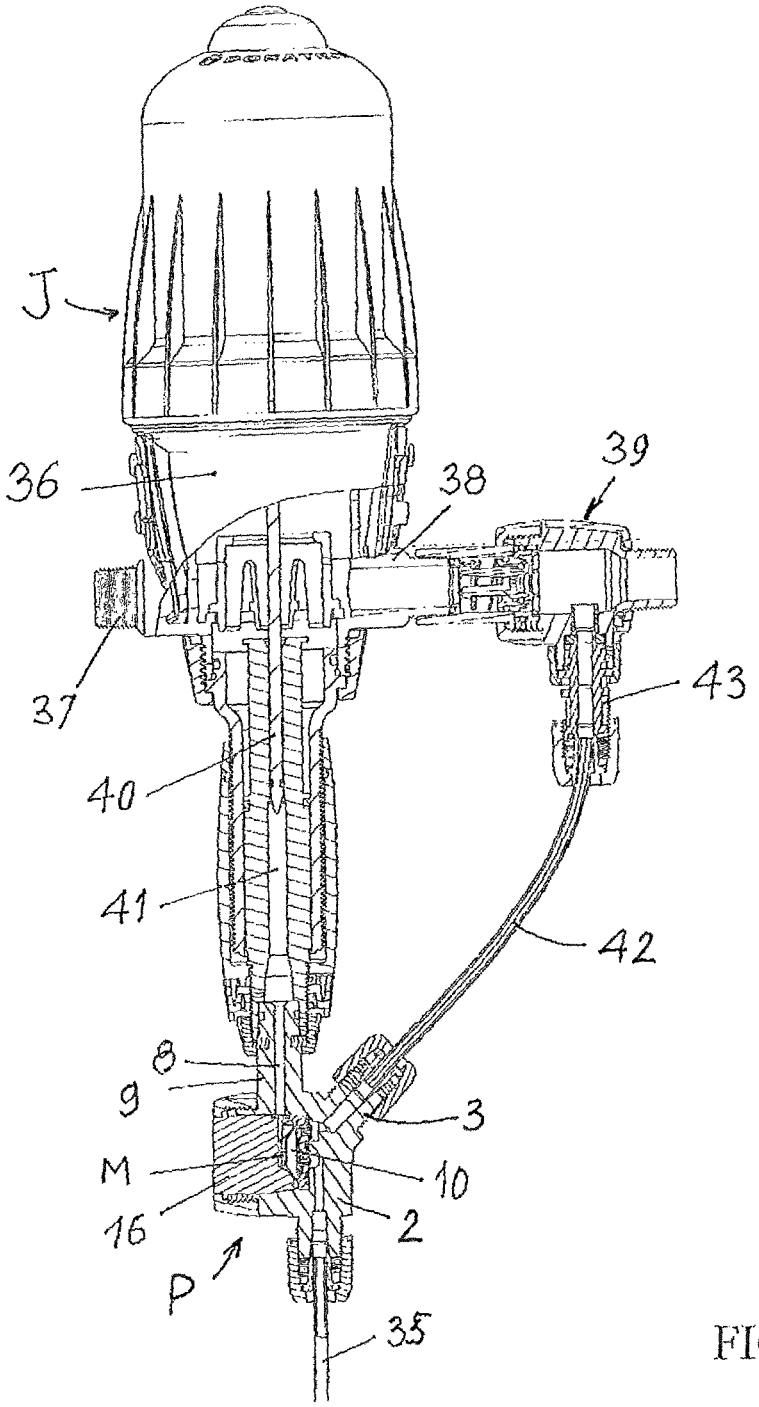
FIG. 5 is a view in partial cross-section, on a smaller scale, of the pump according to FIG. 1 installed in the lower part of a proportional metering device, at the end of the suction course.
Figure 6:
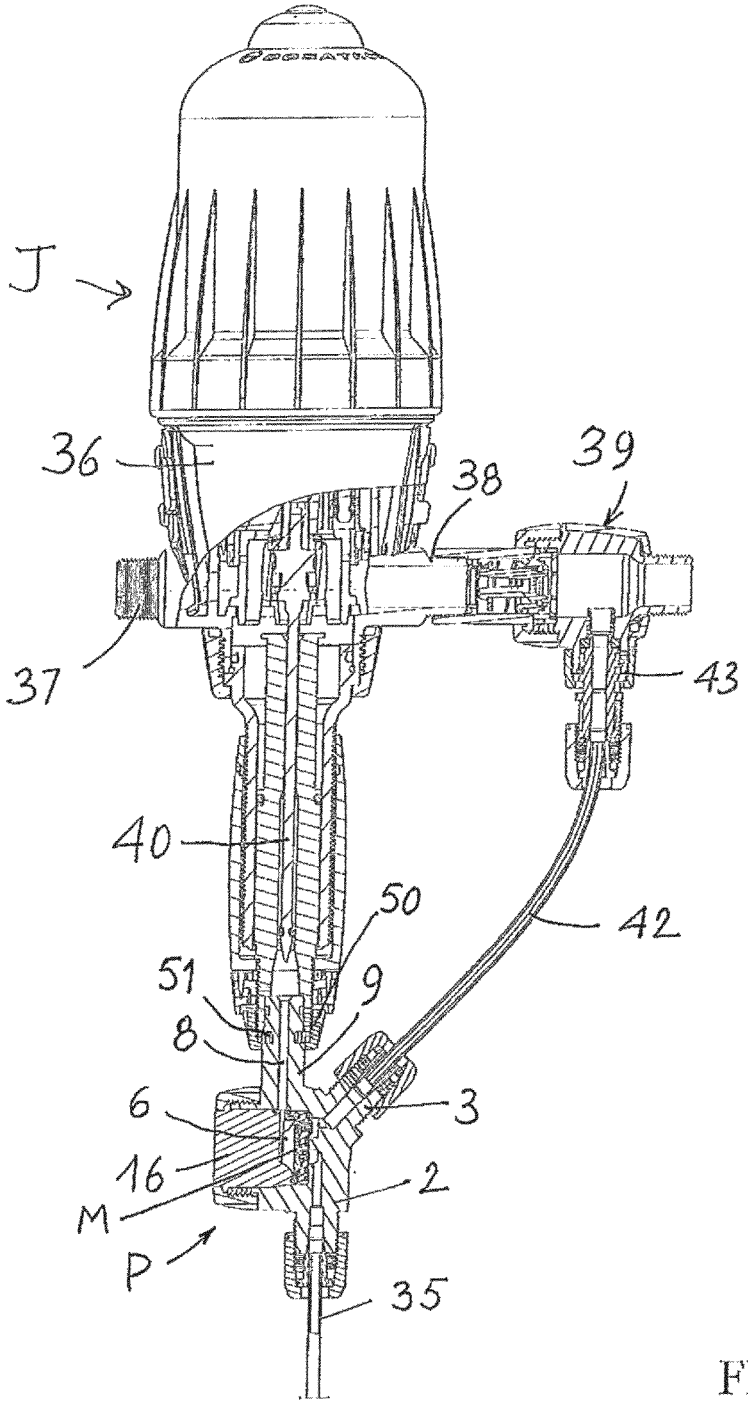

Similarly to FIG. 5, FIG. 6 shows the diaphragm pump at the end of the discharge course.

Figure 1:
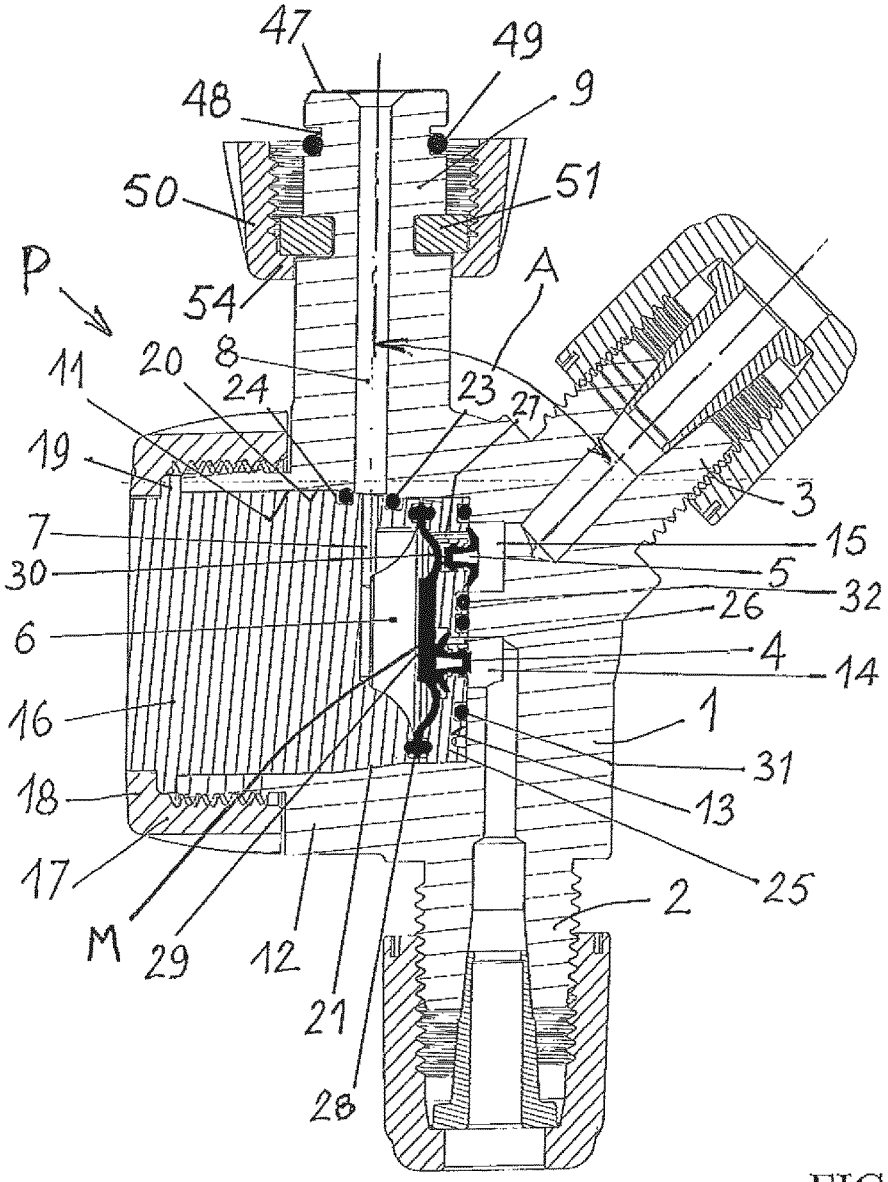
FIG. 1 is a vertical cross-section of a diaphragm pump according to the invention, with the cross-sectional plane passing via the geometric axes of the different connections and of the receptacle provided for the diaphragm.
Figure 7:
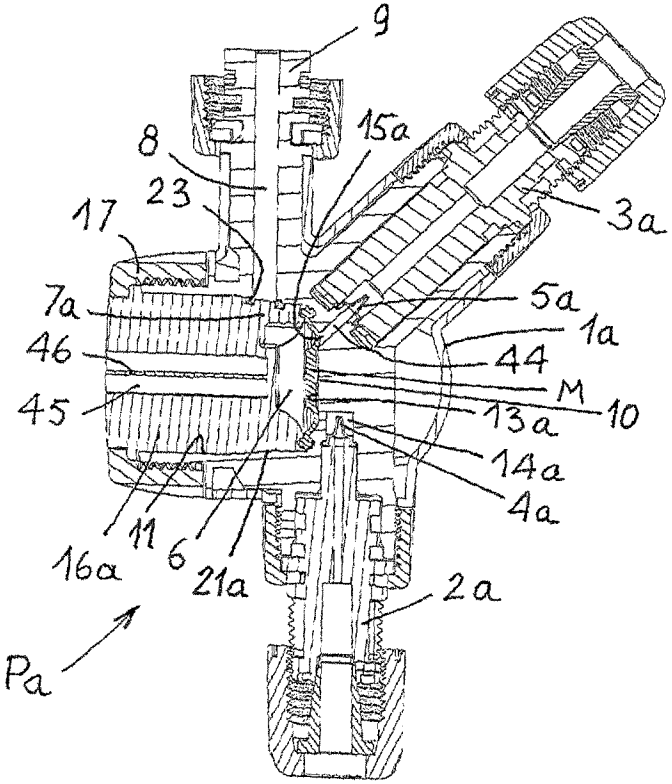

Similarly to FIG. 1, FIG. 7 shows on a smaller scale a variant of the diaphragm pump with suction and discharge valves in the form of a duckbill.

Figure 8:
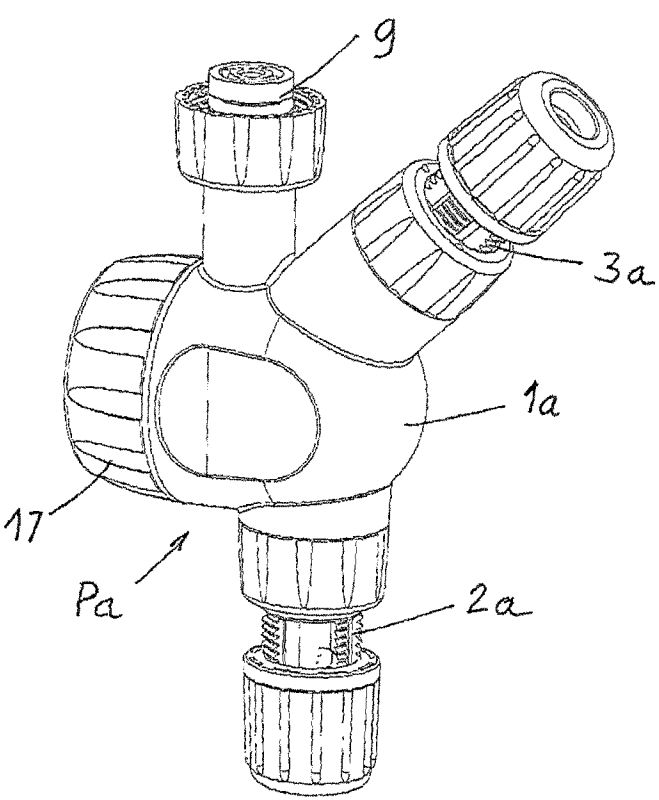

FIG. 8 is an external perspective of the pump in FIG. 7.

Figure 9:
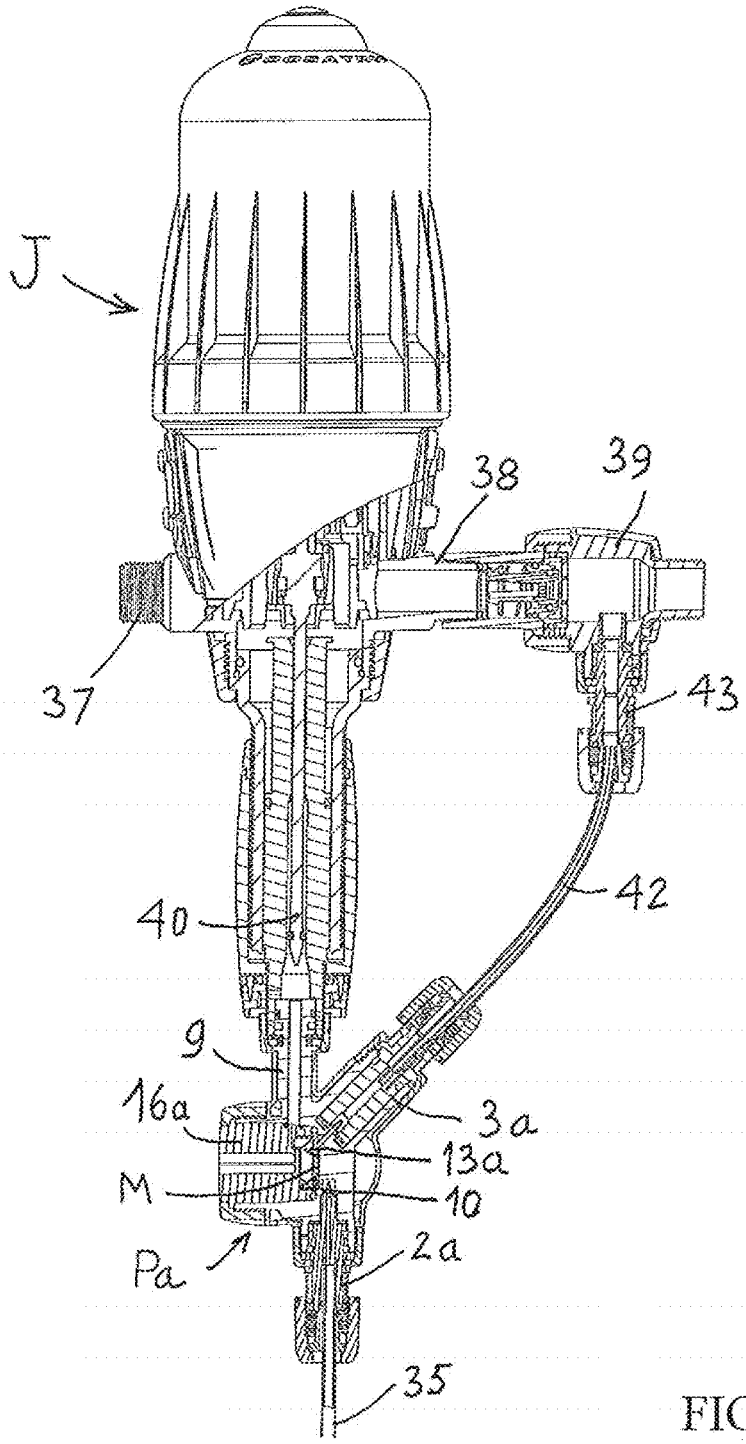

FIG. 9 is a view in cross-section with the external part, on a smaller scale, of the pump in FIG. 7, installed in the lower part of a proportional metering device, which is at the end of discharge.

Figure 10:
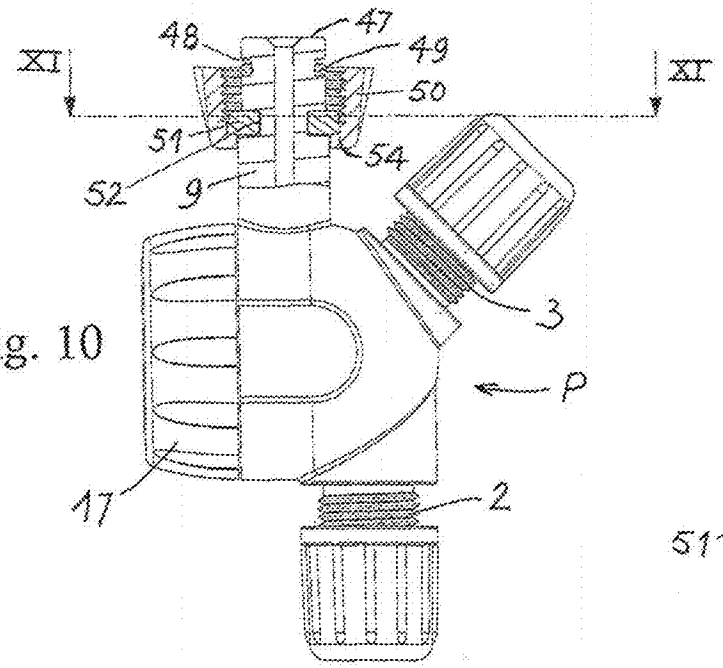
Figure 11:
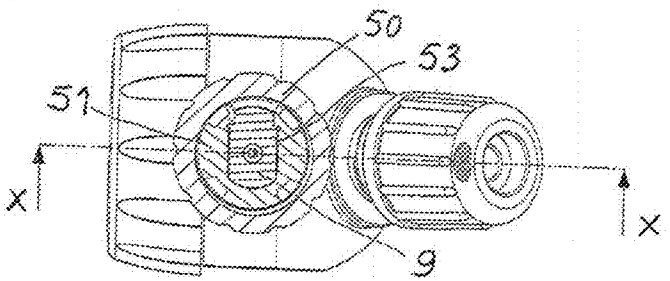

FIG. 10 is an external view of the diaphragm pump in FIG. 1 with a part cut away at the control connection according to the line X-X in FIG. 11.

Figure 12:
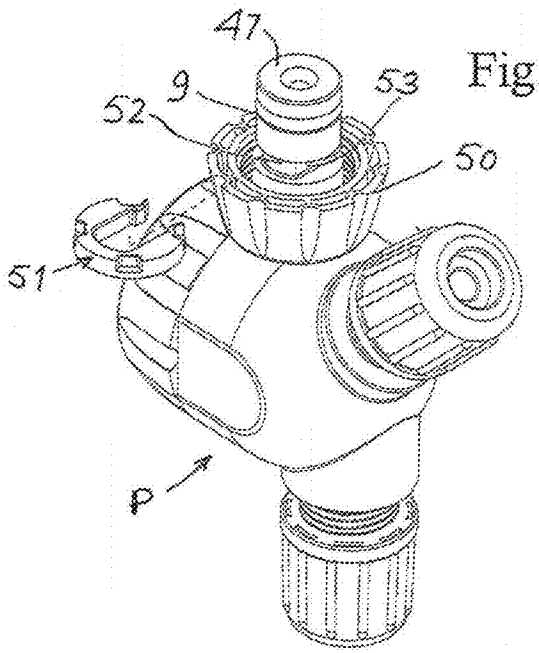

FIG. 11 is a view from above the pump in FIG. 10, according to the line XI-XI in FIG. 10; and FIG. 12 is an external perspective of the pump in FIG. 10, with the clamp spaced from the connection.

FIG. 1 of the drawings shows a diaphragm M to pump P comprising a body 1 provided with a suction connection 2 and a discharge connection 3.

A suction valve 4 and a discharge valve 5 are associated respectively with the suction 2 and discharge 3 connections.

The diaphragm M is disposed in a control chamber 6, which is connected by a passage 7 to a control pipe 8, which makes it possible to apply alternately partial vacuum and pressure in the chamber 6 and on the diaphragm M. The pipe 8 is provided in a control connection 9.

The geometric axes of the connections 2, 3 and 9 and their respective pipes are situated on the same plane. Preferably, the pump P is used in the position represented in FIG. 1, according to which the control connection 9 is in the vertical top part, the suction connection 2 is in the vertical high part, and the discharge connection 3 is inclined upwards. The angle formed between the geometric axes of the pipes provided in the connections 2 and 3 is more than 90°, and preferably equal to 135°, such that the angle A between the geometric axis of the pipe 8 and that of the connection 3 is equal to 45°.

A working chamber 10, which can be seen in FIG. 5, is situated on the side of the diaphragm M opposite the control chamber 6, with the valves 4 and 5 making this chamber 10 communicate either with the suction or with the discharge.

The body 1 comprises a receptacle 11 which is oriented transversely, and preferably at right angles relative to the control pipe 8. This receptacle 11 is provided in a cylindrical protuberance 12 of the body 1, on the side opposite the discharge connection 3. The receptacle 11 is open at one end towards the exterior, and is closed at its other end by a base 13 comprising a suction orifice 14 which is connected to the pipe of the suction connection 2, and a discharge orifice 15 which is connected to the pipe of the discharge connection 3.

The diaphragm M is situated in the vicinity of the base 13, and is retained by a cap 16 which is engaged by translation, without movement of rotation, in the receptacle 11.

The control chamber 6 is provided at the inner end of the cap 16 in the form of a dish which widens in the direction of the diaphragm M. The passage 7 extends orthogonally to the geometric axis of the cap 16, along a length which is greater than the radius of the cap 16, this passage 7 opening onto the lateral surface of the cap, in the alignment of the control pipe 8.

The cap 16 is retained in position by a ring 17 which is connected to the protuberance 12 of the pump body, advantageously by a thread, in which case the ring 17 constitutes a nut. Other means for connection of the ring 17 to the protuberance 12 could be provided, for example, in the form of ramps inclined as a helix.

At its end which is distant from the diaphragm M, the ring 17 comprises a flange 18 which projects radially towards the interior, and constitutes a means for retention of the cap 16, which comprises a peripheral rib 19 which cooperates with the flange 18. The receptacle 11 comprises a frusto-conical intermediate part 20 in the vicinity of the diaphragm M, and the diameter of which decreases in the direction of this diaphragm.

The cap 16 has a conjugated frusto-conical part 21 which is applied against the part 20 during the clamping of the cap 16 by the ring 17.

Figure 2:
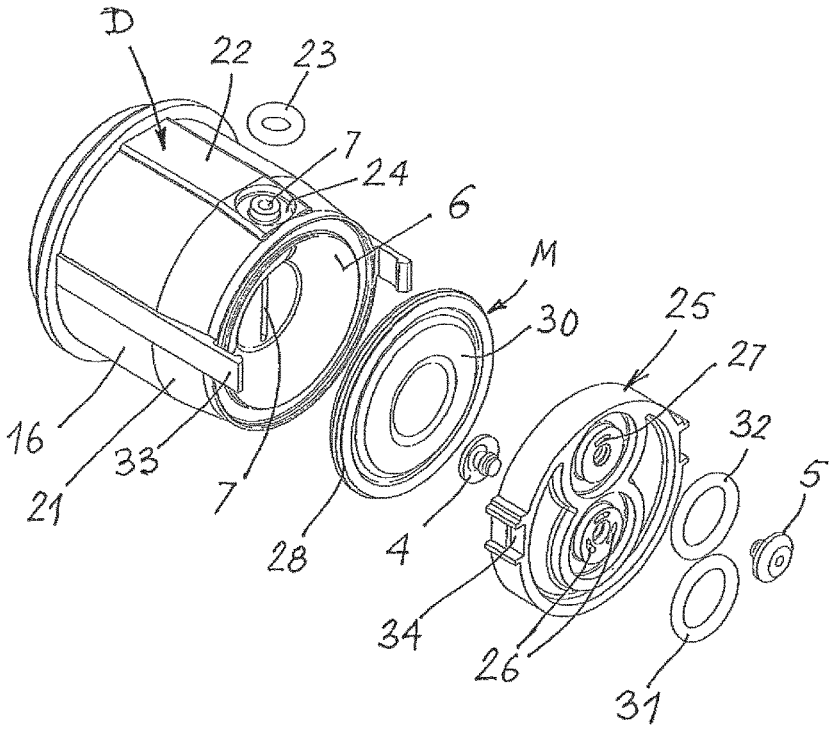
FIG. 2 is an exploded view in perspective of the cap, of the diaphragm, of the plate, of the umbrella valves and of the sealing rings.

In order to ensure correct positioning of the cap 16 in the receptacle 11, so that the passage 7 is in the alignment of the pipe 8, means for polarization are provided between the cap 16 and the receptacle 11, in order to impose the engagement of the cap in the appropriate position. As can be seen in FIG. 2, these means D for polarization comprise a rib 22 which forms a flattened part, projecting on the cylindrical outer surface of the cap, and which can cooperate with a corresponding groove, not shown, provided in the receptacle 11. Preferably, this rib 22 occupies the same angular position as the output of the passage 7.

The sealing between the cap 16 and the body 1 at the output of the passage 7 is advantageously provided by means of a sealing ring 23, in particular an O-ring seal, which in particular is made of elastomer material, accommodated in a groove 24 provided in the oblique surface of the frusto-conical part. This arrangement of the seal 23 on an oblique surface makes it possible to reduce, or even eliminate, the risk of pinching of the seal during the fitting by translation of the cap 16 in the receptacle 1 at the pipe 8.

According to the embodiment in FIG. 1, the pump is equipped with a valve device comprising a plate 25 in which there are fitted the suction valve 5 and the discharge valve 6, advantageously made of elastomer material. Each valve 5, 6 is of the umbrella valve type with a cover in the form of a flexible umbrella, and core which is engaged in, and preferably retained by being snapped into, an orifice in the plate 25. The flexible cover of the suction valve 4 faces towards the diaphragm M, whereas the cover of the discharge valve 5 faces towards the opposite side.

At least one channel 26, 27 passes through the plate in the area which is covered by the cover of the valve. As can be seen better in FIG. 2, three channels 26 are provided in order to pass through the plate in the area of the seat of the cover of the suction valve 4, whereas a single channel 27 is provided in the area of the seat of the discharge valve 5. The presence of a single channel 27 makes it possible to reduce the dead volume of air to be discharged at the time of priming of the pump, between the diaphragm M and the discharge valve 5.

The plate 25 supports the diaphragm M which has on its periphery a rim 28 which is received partly in a peripheral throat in the plate 25, and also partly in a peripheral throat at the end of the cap 16, surrounding the control chamber 6. The diaphragm M comprises a thicker central part 29, which is connected by an annular ring 30 to the rim 28. When it is at rest at the end of discharge, the ring 30 has a cross-section in the form of an arc of a convex curve on the valve side. In this position of rest of the diaphragm, the suction valve 4 is in contact by means of its cover in the form of an umbrella with the diaphragm M, whereas the core of the discharge valve 5 is in contact with the ring 30, such that the dead space between the diaphragm and the valve is reduced to a minimum.

The sealing between the plate 25 and the base of the receptacle around the orifices 14 and 15 is ensured by means of sealing rings 31, 32, in particular O-ring seals made of elastomer material, accommodated in annular throats provided in the plate 25, in order to surround the valves and the orifices 14, 15. The device which is formed by the plate 25, the valves 4 and 5 and the diaphragm M constitutes an interchangeable assembly which can easily be removed and replaced, after removal of the cap 16 and extraction in translation towards the left according to FIG. 1, without intervention on the other connections.

The decrease in, or even elimination of, the dead volume between the diaphragm M and the valves, in particular the discharge valve 5, permits self-priming of the diaphragm pump.

This fitting on a plate, with lateral introduction into the receptacle 11, with fitting and clamping of the diaphragm by means of the cap 16 and a ring-nut 17, amply simplifies the fitting.

Advantageously, as illustrated in FIG. 2, the cap 16 comprises resilient lugs 33 which form clamps, and are preferably diametrically opposite, in an angular position which is offset by a quarter of a turn relative to the rib 22. The lugs 33 make it possible to clamp the cap 16 on the plate 25, by snapping of noses which project on the inner side of the clamps 33 into corresponding receptacles 34 provided in the periphery of the plate 25 in the form of a disc. The valve 4 is put into place on the plate 25 by introduction from the diaphragm side, whereas the valve 5 is put into place from the opposite side.

The embodiment according to FIG. 2 is particularly advantageous since the extraction of the cap 16 after the ring 17 has been unscrewed makes it possible to withdraw the assembly of the plate 25, the diaphragm M and the valves. The plate 25 which has been used can be replaced by a new plate equipped with a new diaphragm M and valves 4, 5.

The plate 25 can easily be made available in different materials, and in particular in materials containing fluorine in order to prevent deposits and to improve the chemical resistance. The plate 25 can also be made of ceramic in the case of products to be pumped which would have an abrasive nature.

The valves 4, 5 made of elastomer material permit versatility of design by changing the materials, in particular in order to resist oxidizing products with a high level of chlorine.

Figure 3:
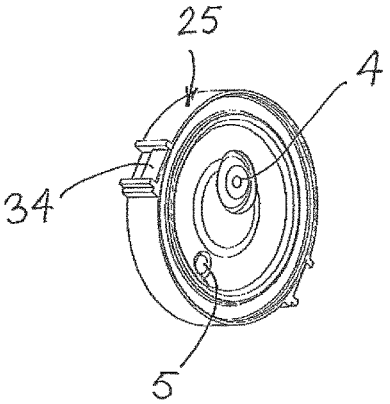
FIG. 3 is a view in perspective of the plate, on the side facing towards the diaphragm.

FIG. 3 shows in perspective the plate 25 seen from the side facing towards the diaphragm, which is not represented. The cover in the form of an umbrella of the suction valve 4 situated on the diaphragm side can be seen in FIG. 3, whereas only the core of the discharge valve 5 can be seen.

Figure 4:
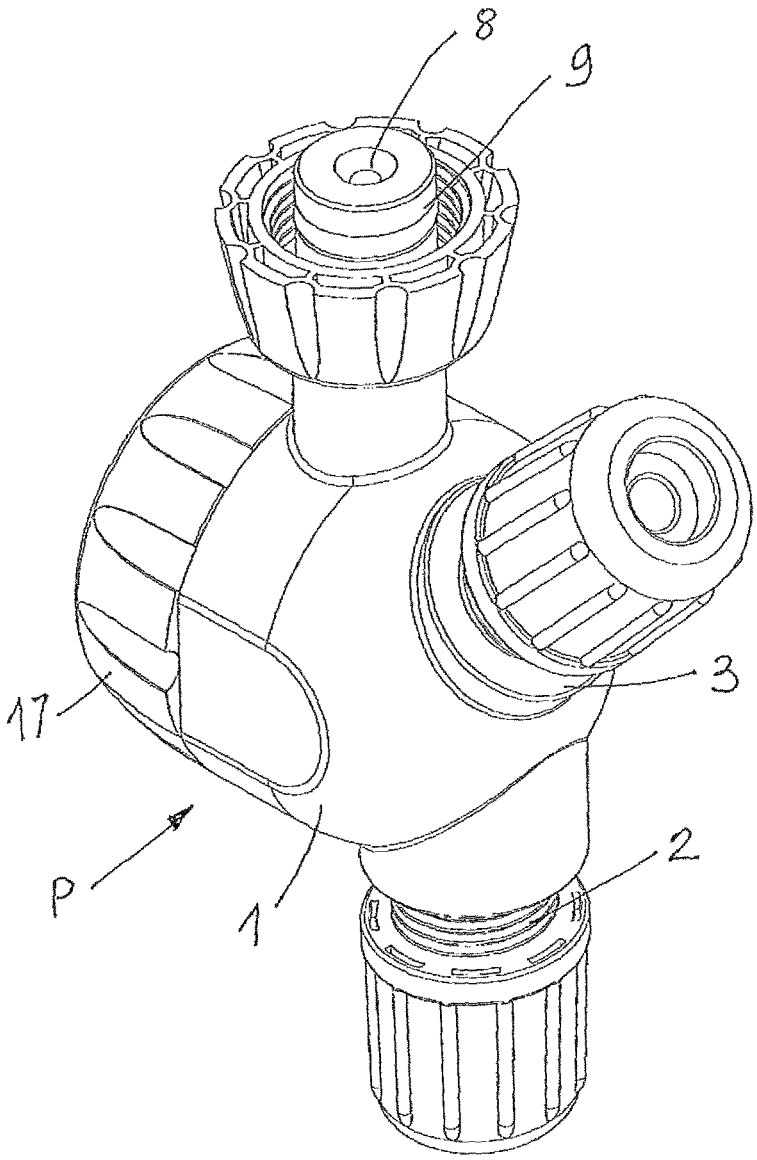
FIG. 4 is an external view in perspective of the pump.

FIG. 4 is an external view in perspective of the pump in FIG. 1.

FIG. 5 represents on a smaller scale in vertical cross-section with an exterior part the pump P in FIG. 1 fitted on the lower end of a proportional metering device J for an auxiliary liquid pumped into a tank, not represented, by a pipe 35 which is connected to the suction connection 2 of the pump P. The auxiliary liquid pumped is injected into a main liquid which penetrates into the body 36 of the metering device via an input 37, and is discharged via an output 38 on which a connection 39 is fitted. A hydraulic motor, not shown, is accommodated in the body 36, which is disposed generally vertically. The motor, which is activated by the main liquid, can be of the type described in patent EP 1971774 B1 in the name of the applicant company. The hydraulic motor is connected to a plunger piston 40, which is vertical according to the arrangement in FIG. 5, in order to drive it in reciprocal straight motion. The plunger piston 40 is displaced in a cylindrical chamber 41, the lower end of which is connected to the control connection 9, such that the variations of pressure in the chamber 41 are transmitted to the control pipe 8.

A suction phase corresponds to the ascending course according to FIG. 5, or outward course, of the plunger piston 40, which creates a partial vacuum in the chamber 41 as well is in the pipe 8 and in the control chamber 6 of the pump P. The suction valve 4 opens such that auxiliary liquid can be sucked into the working chamber 10, whereas the discharge valve 5 is closed. At the end of the ascending course of the piston 40, as represented in FIG. 5, the diaphragm M is applied against the walls of the control chamber 6, and the working chamber 10 has reached its maximum volume.

The discharge connection 3 is connected by means of a flexible pipe 42 to a transverse extension 43, which faces vertically downwards, of the connection 39. The inclination at 45°, or according to an angle close to this value, of the geometric axis of the connection 3 relative to the geometric axis of the pipe 8, makes it possible to provide the pipe 42 with a simple form comprising a straight part followed by an arc of a curve with a large radius of curvature for the branching on the extension 43.

Similarly to FIG. 5, FIG. 6 represents the assembly of the proportional metering device J and the pump P at the end of the discharge phase, the plunger piston 40 being at the end of the descending course. Since the pressure of the liquid in the control pipe 8 and in the control chamber 6 has increased, the diaphragm M has been thrust towards the right in FIG. 6, giving rise to output of the auxiliary liquid (which had been sucked up during the preceding phase) through the discharge valve 5. The auxiliary liquid is discharged towards the pipe 42, and is mixed with the main liquid at the connection 39. The suction valve is closed, and prevents return to the suction pipe 35. At the end of discharge, the diaphragm M is applied against the plate 25 according to the configuration in FIGS. 6 and 1.

FIG. 7 is a vertical cross-section, similar to FIG. 1, of a variant embodiment Pa of the diaphragm pump. Elements of this variant which are identical or similar in terms of their functions to elements already described in relation to FIG. 1 will be designated by the same references, if applicable followed by the letter a, and their description will not be repeated, or will be repeated only briefly.

According to this variant, the suction and discharge valves 4*a*, 5*a* are in the form of a duckbill, i.e. in the form of an inverted "V" for the suction valve 4*a*, and inclined for the discharge valve 5*a*. The tip of the valves in the form of a "V" is oriented in the direction of flow of the liquid. These valves comprise flexible lips which are applied against one another in order to form the inverted or inclined "V", and permit passage of the liquid obtained from the concavity of the "V", and prevent circulation in the inverse direction.

According to a variant not represented, the valves 4*a*, 5*a* in the form of a duckbill can be fitted on a plate similar to the plate 25 in FIG. 1.

According to the variant in FIG. 7, the suction valve 4*a* is installed in a receptacle 14*a* in the pump body 1*a* which communicates with the working chamber 10. The discharge valve 5*a* is installed at the input of the discharge connection 3*a*, downstream from the working chamber, and at the discharge of an inclined pipe 44 which makes the working chamber communicate with the connection pipe 3*a*.

According to this variant, at the end of discharge or in the position of rest of the pump, the diaphragm M is applied directly against the base 13*a* of the receptacle in the pump body.

The cap 16*a*, which is similar to the cap 16 in FIG. 1, comprises a central longitudinal well 45 with a median partition 46, which is designed to facilitate the extraction of the cap 16 after removal of the nut 17.

FIG. 8 is a view in perspective of the exterior of the pump Pa in FIG. 7.

The functioning of the variant Pa in FIG. 7 is similar to that described with reference to the preceding figures.

When a partial vacuum is created in the control pipe 8, the diaphragm M is deformed towards the left in FIG. 7, giving rise to the increase of the volume of the working chamber and suction of an auxiliary liquid through the valve 4*a* which opens under the effect of the partial vacuum whereas the valve 5*a* remains closed.

When the pressure increases in the pipe 8, the diaphragm M is thrust to the right according to FIG. 7, and gives rise to output of the liquid from the working chamber to the pipe 44, through the discharge valve 5*a*, which opens, whereas the suction valve 4*a* remains closed and opposes a return of the liquid into the connection 2*a*.

Similarly to FIG. 6, FIG. 9 shows the pump Pa installed in the lower part of a proportional metering device J, whereas the plunger piston 40 is at the end of the descending course, and the diaphragm M is at the end of the discharge course, whilst being applied against the base 13*a* of the receptacle.

FIGS. 10-12 illustrate an advantageous embodiment of the control connection 9 in order to ensure the retention of the pump P at the lower end of the proportional metering device J, as represented in FIGS. 5 and 6. The elements which are identical or similar to elements already described are designated by the same reference, without their description being repeated in detail.

In the vicinity of its free end on the periphery, the connection 9 comprises a throat 48 in which there is fitted a sealing ring 49, in particular an O-ring seal. As can be seen in FIG. 6, the lower end of the metering device J comprises a bore in which the connection 9 with the ring 49 is engaged in a sealed manner.

A nut 50 is fitted such as to be free in rotation around the connection 9. The nut 50 is retained according to the axial direction by an open clamp 51 comprising a receptacle substantially in the form of a "U" with narrowed ends. The clamp 51, which can be made of plastic material, has a certain resilience in order to snap into a groove 52 in the outer wall of the connection 9. The groove 52 has two diametrically opposed flattened parts 53 against which the branches of the "U" of the clamp 51 are applied after being put into place. The clamp 51 has a circular outer edge, and constitutes a means for axial retention of the nut 50. This nut comprises a flange 54 which projects radially towards the interior and can abut the clamp 51. The nut 50 can be displaced in translation at the rear of the clamp 51.

The lower end of the metering device J comprises on its periphery a thread on which the nut 50 is screwed for retention of the pump P on the metering device J. This structure makes it possible to produce easily a sealed rotary connection 9 with a single sealing ring.

Irrespective of the embodiment adopted, the fitting and removal of the diaphragm M are carried out rapidly and simply, without needing to intervene on the other elements of the pump. The priming of the pump is facilitated by the reduction of the dead volume between the diaphragm and the valves, in particular the discharge valve.

The invention claimed is:

1. A diaphragm pump (M) of the type comprising a body (1, 1*a*) which comprises:

a suction connection (2) and a connection (3) for discharge of the fluid to be pumped, a suction valve (4) and a discharge valve (5) which are associated respectively with the suction and discharge connections;

a control chamber (6) in which a diaphragm (M) is disposed, and a working chamber (10) which is situated on the side of the diaphragm opposite the control chamber;

a control pipe (8) which can connect the control chamber (6) to a control connection (9) of the body, this control pipe making it possible to apply alternately partial vacuum and pressure on the diaphragm;

a receptacle which is open towards the exterior at one end, and is closed at its other end by a base (13, 13*a*) comprising a suction orifice (14, 14*a*) and a discharge orifice (15, 15*a*), the diaphragm (M) being situated adjacent the base, or against the base, and being retained by a cap (16, 16*a*) which is engaged in the receptacle, this cap having, at its end which faces towards the diaphragm, a recess which constitutes the control chamber (6), wherein the receptacle (11) is oriented transversely, to the control pipe (8), the recess which constitutes the control chamber (6) is connected to a passage (7, 7*a*) which opens onto the lateral surface of the cap, in order to establish communication with the control pipe (8), and the cap (16, 16*a*) is retained in place in the receptacle by a ring (17), which is connected to the body of the pump, and comprising a means (18) for retention of the cap; and a valve device which comprises a plate (25) in which the suction valve (4) and the discharge valve (5) are fitted, with the plate supporting the diaphragm (M), and being retained against the base (13) of the receptacle by the cap (16).

2. The pump as claimed in claim 1, wherein the suction orifice (14) and the discharge orifice (15) are provided in the base of the receptacle (13) opposite the corresponding valves which are supported by the plate, and a sealing ring (31, 32) is fitted on the plate around each valve, in order to ensure the sealing between the plate and the pump body.

3. The pump as claimed in claim 2, wherein at least one channel (26, 27) for flow of the fluid to pass through the plate (25) is provided at the discharge orifice (15), in order to reduce the dead volume between the diaphragm and the discharge valve.

4. The pump as claimed in claim 1, wherein at least one channel (26, 27) for flow of the fluid to pass through the plate (25) is provided at the discharge orifice (15), in order to reduce the dead volume between the diaphragm and the discharge valve.

5. The pump as claimed in claim 1, wherein the plate (25) is snapped onto the end of the cap (16).

6. The pump as claimed in claim 1, wherein the suction (4) and discharge (5) valves are constituted by valves of the umbrella type with a core engaged in an orifice in the plate (25), and a flexible flange or cover which closes the channel(s) (26, 27) which pass through the plate.

7. The pump as claimed in claim 6, wherein the valves (4, 5) are in contact with the diaphragm (M) when the pump is at rest or at the end of discharge, such that the dead volume between the diaphragm and the discharge valve is non-existence.

8. The pump as claimed in claim 1, wherein the suction (4*a*) and discharge (5*a*) valves are constituted by valves in the form of a duckbill comprising two flexible lips which are applied against one another according to a configuration in the form of a "V", the tip of which faces in the direction of flow of the fluid.

9. The pump as claimed in claim 1, wherein the suction and discharge valves of the umbrella type or in the form of a duckbill are disposed in receptacles in the pump body, and the diaphragm (M) is applied directly against the base (13*a*) of the receptacle.

10. The pump as claimed in claim 1, wherein the geometric axis of the suction connection (2, 2*a*) is parallel to the geometric axis of the control pipe (8), whereas the geometric axis of the discharge connection (3, 3*a*) forms an angle (A) of 45°, with the geometric axis of the control pipe (8).

11. The pump as claimed in claim 1, wherein the passage (7, 7*a*) is provided in the cap (16, 16*a*) in order to connect the control chamber (6) to the control pipe (8) extends along a length which is longer than the radius of the cap, in order to reduce the risk of interruption of the suction by adhesion of the diaphragm against the base of the control chamber.

12. The diaphragm pump as claimed in claim 1, wherein the pump is installed in the lower part of a proportional metering device (J), comprising a metering device body (36) with a main liquid input (37) and an output (38), a plunger piston (40) displacable in a cylindrical chamber (41) which during a suction stroke the partial vacuum is transmitted by the control pipe (8) to the control chamber (6) of the diaphragm pump, and a discharge, which thrusts the diaphragm when the plunger piston carries out a return course.

13. A valve device for a diaphragm pump as claimed in claim 1, wherein, the suction valve (4) and the discharge valve (5) each include a cover in the form of an umbrella and a core which is accommodated in an orifice in the plate, and further comprising at least one channel (26, 27) passing through the plate in in areas covered by the covers of the valves.

14. The pump as claimed in claim 1, wherein a single channel (26, 27) for flow of the fluid to pass through the plate (25) is provided at the discharge orifice (15), in order to reduce the dead volume between the diaphragm and the discharge valve.

15. A diaphragm pump (M) of the type comprising a body (1, 1*a*) which comprises:

a suction connection (2) and a connection (3) for discharge of the fluid to be pumped, a suction valve (4) and a discharge valve (5) which are associated respectively with the suction and discharge connections;

a control chamber (6) in which a diaphragm (M) is disposed, and a working chamber (10) which is situated on the side of the diaphragm opposite the control chamber;

a control pipe (8) which can connect the control chamber (6) to a control connection (9) of the body, this control pipe making it possible to apply alternately partial vacuum and pressure on the diaphragm;

a receptacle which is open towards the exterior at one end, and is closed at its other end by a base (13, 13*a*) comprising a suction orifice (14, 14*a*) and a discharge orifice (15, 15*a*), the diaphragm (M) being situated adjacent the base, or against the base, and being retained by a cap (16, 16*a*) which is engaged in the receptacle, this cap having, at its end which faces towards the diaphragm, a recess which constitutes the control chamber (6), wherein the receptacle (11) is oriented transversely, to the control pipe (8), the recess which constitutes the control chamber (6) is connected to a passage (7, 7*a*) which opens onto the lateral surface of the cap, in order to establish communication with the control pipe (8), and the cap (16, 16*a*) is retained in place in the receptacle by a ring (17), which is connected to the body of the pump, and comprising a means (18) for retention of the cap, wherein the cap (16, 16*a*) has a surface comprising a cylindrical part and a frusto-conical part (21, 21*a*) which can be applied against a conjugated frusto-conical surface (20) of the receptacle, with the passage (7, 7*a*) provided in the cap for connection to the control pipe opening in this frusto-conical part, and being opposite the control pipe.

16. The pump as claimed in claim 15, wherein a means (D) for polarization is provided on the lateral surface of the cap in order to cooperate with the means for polarization which is conjugated with the receptacle, in order to ensure the appropriate positioning of the passage (7, 7*a*) relative to the control pipe (8).

17. The pump as claimed in claim 16, wherein the sealing of the connection between the passage (7, 7*a*) of the cap and the control pipe (8) is ensured by a sealing ring (23) which surrounds the output of the passage on the frusto-conical surface.

18. The pump as claimed in claim 15, wherein the sealing of the connection between the passage (7, 7*a*) of the cap and the control pipe (8) is ensured by a sealing ring (23) which surrounds the output of the passage on the frusto-conical surface.

19. The pump as claimed in claim 18, wherein the ring (23) is accommodated in a circular groove provided (24) in the frusto-conical surface of the cap (16).

20. A diaphragm pump (M) of the type comprising a body (1, 1*a*) which comprises:

a suction connection (2) and a connection (3) for discharge of the fluid to be pumped, a suction valve (4) and a discharge valve (5) which are associated respectively with the suction and discharge connections;

a control chamber (6) in which a diaphragm (M) is disposed, and a working chamber (10) which is situated on the side of the diaphragm opposite the control chamber;

a control pipe (8) which can connect the control chamber (6) to a control connection (9) of the body, this control pipe making it possible to apply alternately partial vacuum and pressure on the diaphragm;

a receptacle which is open towards the exterior at one end, and is closed at its other end by a base (13, 13*a*) comprising a suction orifice (14, 14*a*) and a discharge orifice (15, 15*a*), the diaphragm (M) being situated adjacent the base, or against the base, and being retained by a cap (16, 16*a*) which is engaged in the receptacle, this cap having, at its end which faces towards the diaphragm, a recess which constitutes the control chamber (6), wherein the receptacle (11) is oriented transversely, to the control pipe (8), the recess which constitutes the control chamber (6) is connected to a passage (7, 7*a*) which opens onto the lateral surface of the cap, in order to establish communication with the control pipe (8), and the cap (16, 16*a*) is retained in place in the receptacle by a ring (17), which is connected to the body of the pump, and comprising a means (18) for retention of the cap, wherein, for the retention of the pump on a metering device, the control connection (9) of the pump comprises a clamp (51) snapped onto the connection, and a means for connection to the metering device, which is retained axially by said clamp.

* * * * *